US005901565A

United States Patent [19]

Morton, Jr.

[11] Patent Number: 5,901,565

[45] Date of Patent: May 11, 1999

[54] SLANTED HEAT EXCHANGER-ENCASED FAN-DEHUMIDIFIER

[75] Inventor: James J. Morton, Jr., Eagleville, Tenn.

[73] Assignee: Whirlpool Corporation, Benton Harbor, Mich.

[21] Appl. No.: 08/956,485

[22] Filed: Oct. 23, 1997

[51] Int. Cl.[6] ..... F25D 31/00

[52] U.S. Cl. ..... 62/285; 165/103; 165/227

[58] Field of Search ..... 62/285; 165/103, 165/227

[56] References Cited

U.S. PATENT DOCUMENTS

| | | | |
|---|---|---|---|
| D. 170,900 | 11/1953 | Wilson | D62/4 |
| D. 181,683 | 12/1957 | Steiner | D62/4 |
| D. 308,414 | 6/1990 | Makihara | D23/359 |
| D. 310,412 | 9/1990 | Fukumoto et al. | D23/359 |
| D. 312,303 | 11/1990 | Gustavsson | D23/359 |
| D. 357,311 | 4/1995 | Yehl | D23/364 |
| 2,930,208 | 3/1960 | Lyman | 62/428 |
| 3,500,654 | 3/1970 | Sholtes | 62/150 |
| 3,628,590 | 12/1971 | Knebusch | 62/290 |
| 3,741,290 | 6/1973 | Nenadal | 165/48 |
| 3,938,348 | 2/1976 | Rickert | 62/97 |
| 4,428,207 | 1/1984 | Hall | 62/176 |
| 4,474,232 | 10/1984 | Wright et al. | 165/137 |
| 5,117,651 | 6/1992 | Suh | 62/228 |

*Primary Examiner*—Henry A. Bennett
*Assistant Examiner*—Mark Shulman
*Attorney, Agent, or Firm*—Robert O. Rice; Thomas J. Roth; Stephen D. Krefman

[57] ABSTRACT

A room dehumidifier includes a closed refrigerant cycle apparatus with an evaporator coil inclined at 20 from vertical on an air inlet side of the dehumidifier, which also includes openings in the cabinetry to allow a substantial portion of inlet air to bypass the evaporator coil, a fan and orifice plate arranged downstream of the evaporator coil, bypass openings to draw air through the cabinet, and a condenser coil arranged vertically on an outlet side of said fan. The fan blows air through the condenser coil and out back side louvers of the cabinet. A drip bucket is located beneath the evaporator coils and a compressor is located beneath the condenser coils.

24 Claims, 3 Drawing Sheets

SLANTED HEAT EXCHANGER-ENCASED FAN-DEHUMIDIFIER

BACKGROUND OF THE INVENTION

The present invention relates to heat exchange appliances in general and in particular to a fan dehumidifier which uses a refrigerant cycle system to condense water vapor in the air onto an evaporator coil which is disposed above a drain pan and the air is then heated by a condenser coil to room temperature.

Known room dehumidifiers such as those described in U.S. Pat. No. 5,117,651 can suffer from design features that prevent them from utilizing the maximum efficiency of their heat exchangers. In known dehumidifiers the same air flow volume flows through the evaporator as through the condenser which may not efficiently match the two exchangers. Air flow patterns can be non-uniform over the surface of the heat exchangers. Warm air discharges in the direction of room occupants, and heat from the condenser easily radiates to the evaporator because of their close proximity.

SUMMARY OF THE INVENTION

According to the invention a room dehumidifier is provided with an evaporator located at an inlet thereof, slanted with respect to the vertical and arranged above a drip pan and a bucket. Sequentially, after the evaporator, is located a fan motor and a fan impeller which draws air through the evaporator as well as through bypass openings. After the fan and motor, sequentially, is located the condenser coil. By substantially separating the condenser coil and the evaporator coil and placing the fan and fan motor therebetween, the separation substantially reduces heat from being radiated from the condenser coil to the evaporator coil. The direction of air flow has been reversed from known dehumidifiers to stop the warm discharge air from blowing onto the room occupant, and is instead discharged away from the occupant, out the back of the appliance.

A greater distance is provided between the fan and the surface of the heat exchangers thus allowing for a more uniform air flow pattern through these exchangers. The construction of the dehumidifier permits a certain amount of air to be drawn through a defined opening into the fan's inlet, this includes air that is permitted to pass through the evaporator and air permitted to bypass the evaporator. These two air flows are combined at the fan inlet and then discharged through the condenser. By placing the fan between the two heat exchangers, the evaporator is subjected to air being drawn through it, while the condenser is subjected to air being blown through it. This enables a very important benefit, that is, the air flow through the condenser is greater than the air flow through the evaporator. This phenomenon enables a greater heat rejection rate and thus enables more efficient use of the exchangers heat carrying capacity in the evaporator coil. The bypass allows for greater air flow through the condenser than the current design resulting in a lower discharge air temperature and reducing the amount of heat the consumer perceives as coming from the dehumidifier. According to one aspect of the invention, the evaporator coil is slanted at a prescribed angle. The condenser coil is arranged vertically. The fan motor, fan impeller (blades), and a fan orifice plate comprising a sandwiched air system is arranged between the evaporator and condenser coils.

The evaporator coil is slanted to an optimum angle of about 20. At this angle, tests show that an increase in condensate run-off is obtainable (more dehumidifier capacity). The slanting of this coil also plays a large role in the overall aesthetic appearance of the unit.

Bypass air is defined as any air that reaches the condenser coil that has not gone through the evaporator coil, i.e., bypassing the evaporator. The ability to use bypass air greatly improves energy efficiency and allows a reduction of compressor size on some models. It is also conceivable that a reduction in the size of the condenser coil can be made possible. Additionally, the inventive system is not as susceptible to freezing of the evaporator coil at lower ambient temperatures, as are prior art devices. This quality can possibly eliminate the need for a de-icing control on this product.

In operation, when air enters the front louvers of the evaporator coil, a portion goes through the evaporator coil where it is dehumidified, and an additional quantity of air is allowed to enter the lower static pressure areas that bypass the evaporator coil. This air is mixed with additional bypass air that is coming from louvers formed through the cabinet sides.

It should be noted that the structure can be arranged for the bypass air to pass the evaporator coils in the bottom area below the evaporator coil, the area at the top of the evaporator coil, or it can be through the coil support panels directly behind the evaporator coil, or in any combination thereof.

The optimum bypass air size can be determined by the capacity and the characteristics of the components used in the dehumidifier. The bypass opening area size can vary with capacity or change of the components used to manufacture the dehumidifier.

The evaporator coil has been slanted to increase the amount of condensate run-off. A coil slanted at an angle of 20 delivers more condensate. At this slanted angle, a 10–15% increase in capacity can be obtained.

Because of the separation of the evaporator and condenser coils, the amount of radiated heat therebetween has been greatly reduced. Current designs have the coils connected in very close proximity to each other, and radiant heat from the condenser is absorbed by the evaporator, reducing overall efficiency. It is advantageous to apply a fan orifice plate between the coils which optically isolates (isolates from heat radiation) a majority of the coil. Optically isolated means that there is an actual structure (orifice plate, motor, and fan blade) between the evaporator and condenser coils; "visually" a substantial amount of the coil surface cannot be seen from the opposite side. Optical terminology is analogous to radiant heat terminology in this regard.

The pull through, push through, air flow arrangement, with the sandwiched fan coil assembly, provides a more uniform air flow pattern. This improves the appliance efficiency and reduces the sound level of the appliance. Additionally, increasing the amount of air flow through the condenser lowers the discharge pressure and temperature, thus, increasing the efficiency of the appliance. A more unified air flow pattern allows the use of the same size coils to obtain increased capacity results, with lower pressures and temperatures on the condenser side, and increased pressures and temperatures on the evaporator.

DETAILED DESCRIPTION OF THE PREFERRED EMBODIMENTS

Figure 2:
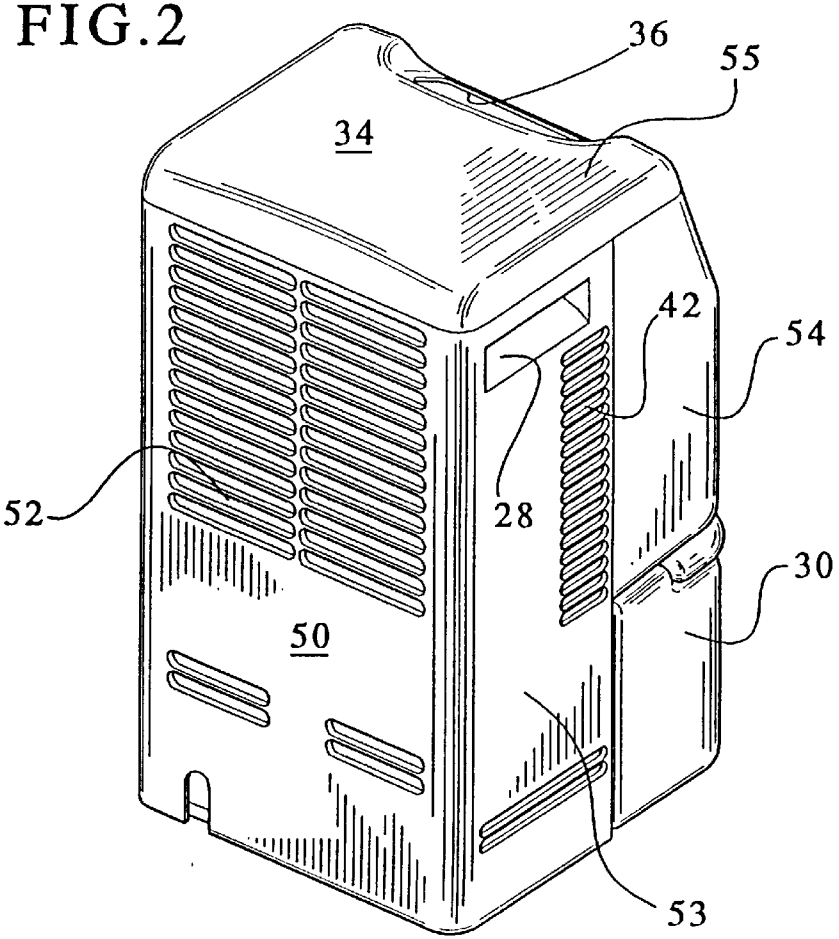
FIG. 2 is a perspective view of a back side of the room dehumidifier shown in FIG. 1.
Figure 1:
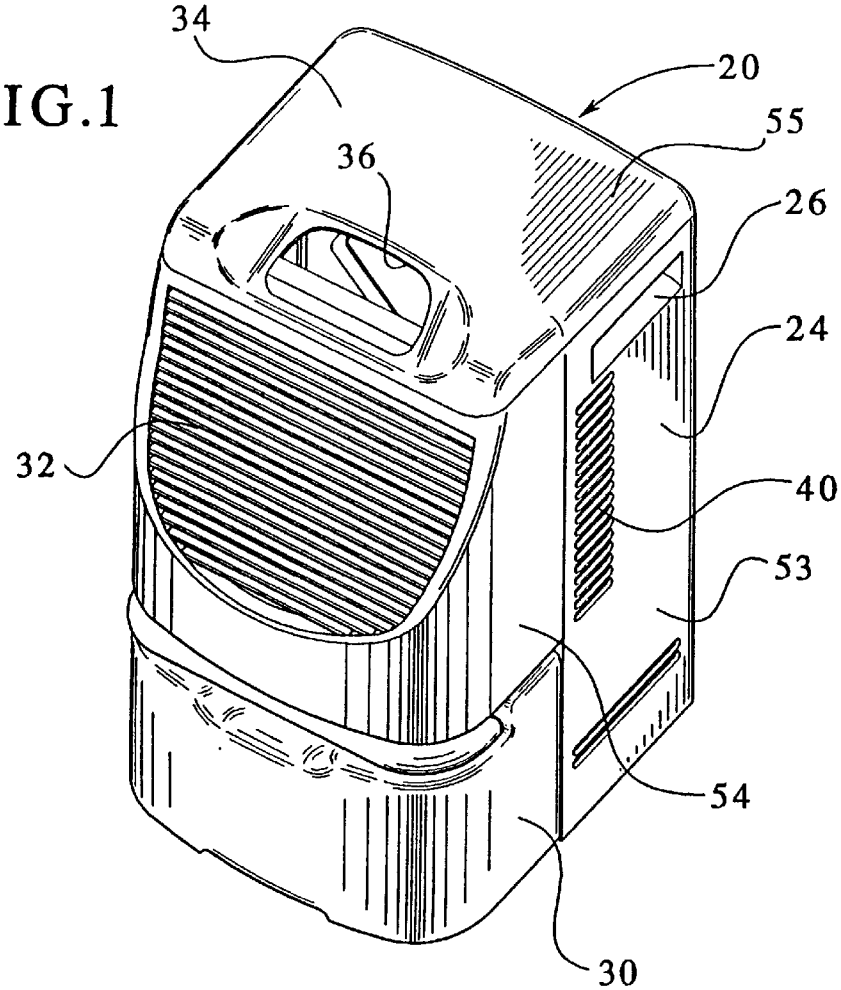
FIG. 1 is a perspective view of a front side of the present room dehumidifier.
Figure 3:
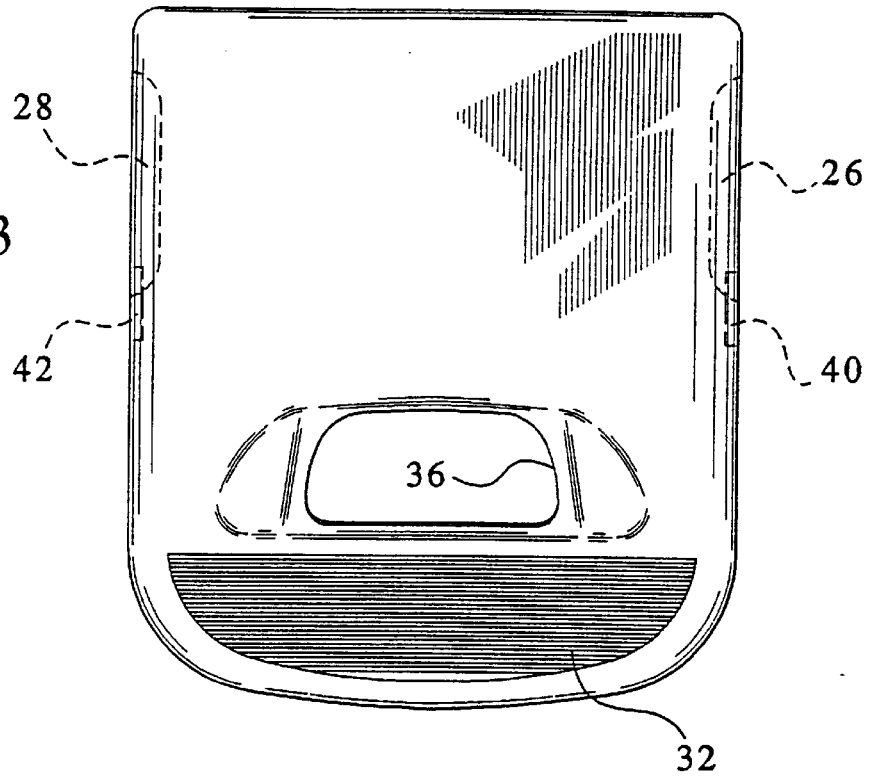
FIG. 3 is a top plan view of the dehumidifier shown in FIG. 1.

FIG. 1 illustrates a room dehumidifier 20 which includes a set down sheet metal or plastic cabinet 24 having side handles 26, 28 (see FIG. 2). At a bottom of the front side of the cabinet 24 is a slide out bucket 30 above which is arranged a drip pan "83, having a side wall 83*a,* a bottom wall 83*b* a drain outlet 83*c* (FIG.4)". On above which is located an evaporator side grill or louvers 32. Additional bypassing can be obtained by openings in the top cover. A top opening 36 is provided for installation of a control panel (not shown). On sides of the cabinet are vertically arranged side louvers 40, 42 for air entry. On a back wall 50 of the cabinet, as shown in FIG. 2, are arranged condenser louvers 52 for allowing the passing of warmed air out of the unit.

The cabinet 20 can be constructed of a rear cabinet component 53, a front cabinet component 54, and a top component 55, all connected together such as by screws or other means.

Figure 4:
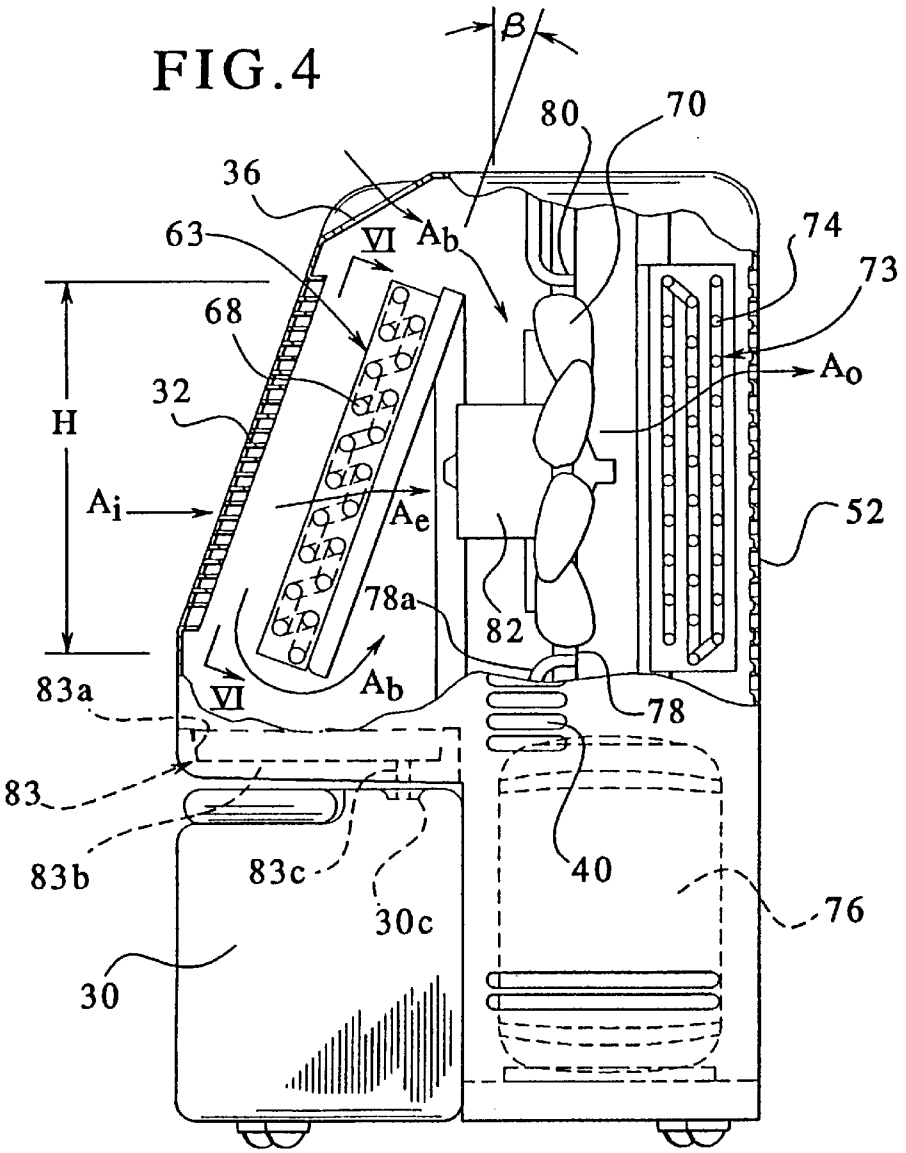
FIG. 4 is a right side view of the dehumidifier shown in FIG. 1.

As shown in FIGS. 4, outside air $A_i$ enters the grill 32 where a portion of the air $A_e$ passes through an evaporator 63 having coils 68 and another portion $A_b$ bypasses the evaporator 63. Also, bypass air $A_b$ passes through the louvers 40 which does not pass through the evaporator coils 68. The combined flow $A_e$ passing through the evaporator, and $A_b$ bypassing the evaporator, is drawn by a fan 70 therethrough and the entire amount $A_o$ passes through a condenser 73 having coils 74 to exit the dehumidifier through the louvers 52. The evaporator coils 68 are flow connected to a compressor 76 to deliver refrigerant thereto while the compressor 76 is flow connected to the condenser coils 74, and to complete the circuit, the condenser coils 74 are connected via a pressure reducing valve to the evaporator coils 68. Air $A_e$ which passes through the evaporator coils 68 is cooled and water condensate collects on the coils 68 where it drips down into the drip pan 83 and then drains into the bucket 30. When the drip bucket is filled, user empties the bucket.

It has been determined that the evaporator coils 68 should advantageously be angled to the vertical at an angle "β" which equals 20. Between the evaporator coils 68 and the condenser coils 74 is located the fan blades 70 arranged within an orifice 70 of an orifice plate 80, and a fan motor 82.

Figure 6:
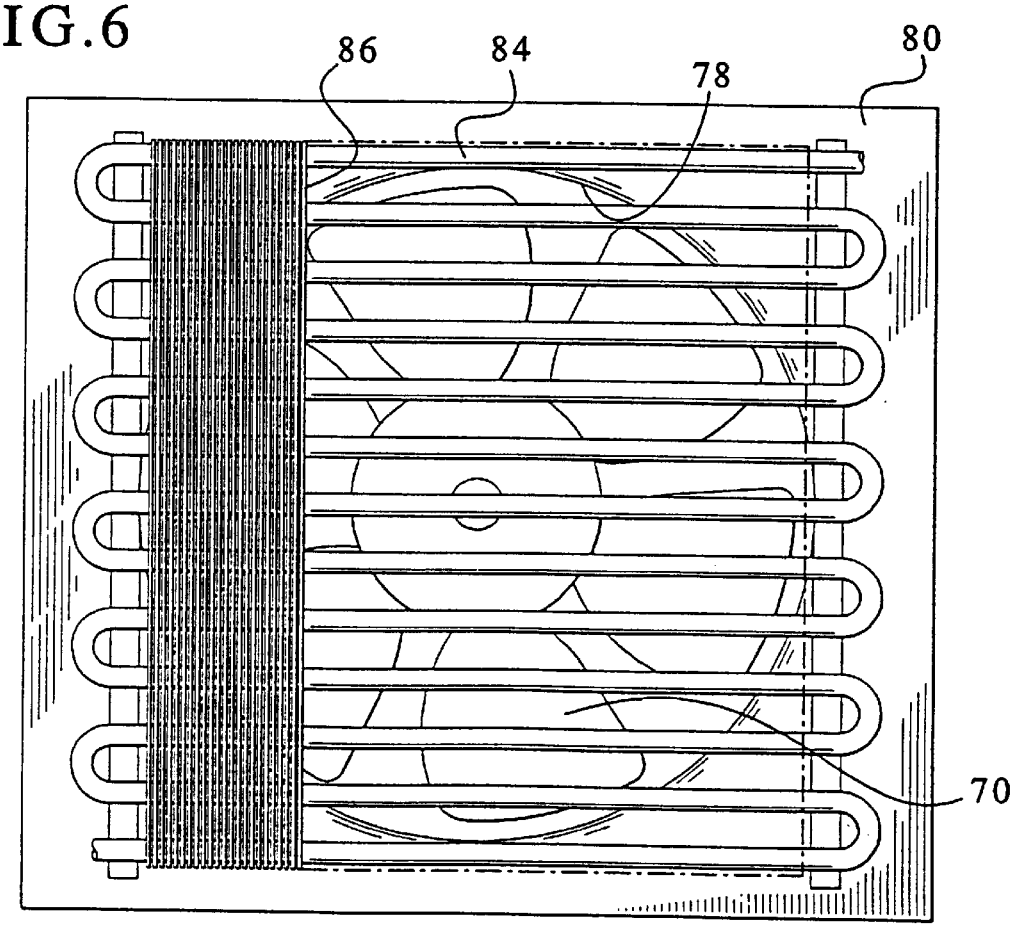
FIG. 6 is a sectional view taken generally along line VI—VI of FIG. 4.
Figure 5:
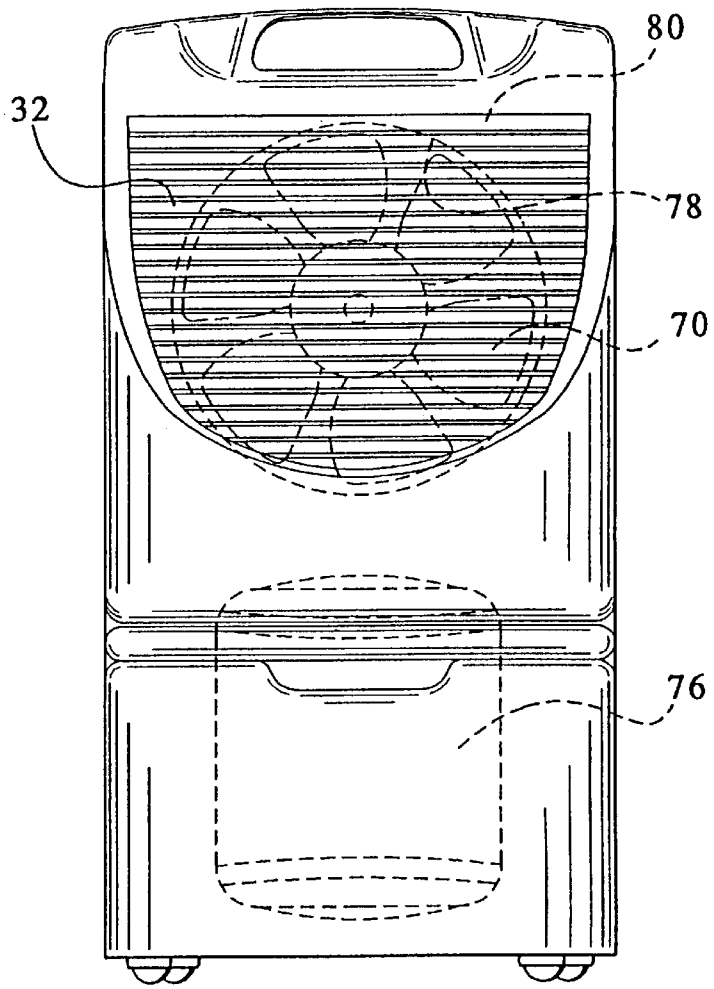
FIG. 5 is a front view of the dehumidifier shown in FIG. 1.

As shown in FIG. 6, the coils 68 of the evaporator are composed of a generally horizontal, serpentine tube 84 of an acceptable heat transfer material such as copper, having a plurality of closely spaced parallel plates or fins 86 connected around the tube. Such fins can be in the form of annular plates connected around each length of tube having a free outer circular edge or can be a continuous elongate, generally rectangular plate spanning between tube passes, as shown. These fins provide an extended heat transfer surface. The condenser coils 74 are similarly fashioned as a horizontal serpentine tube with plate fins 86. Also shown is the orifice plate 80 which acts as a baffle for the fan to direct air into the orifice 78 and also optically shields the evaporator coils 68 from the condenser coils 74. The orifice is formed having a fluted or rounded rim 78*a* to assist smooth air flow into the fan blades. The orifice plate is advantageously composed of a radiation reflective color such as white and has an insulating value as well, such plate being a plastic or fiberglass panel. The orifice plate can also be sheet metal, such as a zinc coated sheet metal.

This plate structure, along with the fan and fan motor, optically isolates the evaporator coils 68 from the condenser coils 74 to prevent radiation heat transfer between the coils, and further optimizes and makes more efficient the refrigerant cycle.

It is noted in viewing FIG. 4, that the evaporator 63 and condenser 73 are separated by a significant distance by the interpositioning of the fan 60 and motor 82. Along with the shielding effect of the plate 80 this reduces undesirable heat transfer between the condenser 73 and the evaporator 63. Additionally, as shown in FIG. 4 the evaporator 63 and condenser 73 have the same approximate vertical profile H and are aligned horizontally. This promotes smooth, uniform air flows and reduced pressure losses. The condenser 73 and evaporator 63 are also separated a significant distance from the fan 70 which promotes smooth air flow through the two exchangers 63, 73. The relative distances of the evaporator 63, fan 70 and condenser 73 shown in FIG. 4 are substantially shown to scale.

Although the present invention has been described with reference to a specific embodiment, those of skill in the art will recognize that changes may be made thereto without departing from the scope and spirit of the invention as set forth in the appended claims.

We claim:

1. In an appliance having a closed refrigerant cycle apparatus therein including a condenser, and evaporator, a compressor, and a means for flow connecting refrigerant therebetween, the improvement comprising:

a cabinet having an air inlet opening, a bypass opening, and an air outlet opening;

rotatable fan blades arranged between said air inlet opening and said air bypass opening, and said air outlet opening;

an evaporator coil arranged between said air inlet opening and said fan; and a condenser coil arranged between said fan and said air outlet opening.

2. The improvement according to claim 1, further comprising a plate having an orifice for surrounding said fan blades, said plate substantially optically shielding said evaporator coil from said condenser coil and arranged therebetween.

3. The improvement according to claim 1, further comprising a drip bucket arranged beneath said evaporator coils and removable from said cabinet.

4. The improvement according to claim 1, wherein said air bypass opening comprises louvered openings arranged through a side of said cabinet between said evaporator coil and said fan.

5. The improvement according to claim 1, wherein said air bypass opening comprises a top opening through said cabinet.

6. The improvement according to claim 1, wherein said bypass opening comprises an open space below said evaporator coils within said cabinet in communication with said air inlet.

7. The improvement according to claim 1, wherein said air inlet opening is covered by a grill which is inclined at about 20 to the vertical.

8. The improvement according to claim 1, further comprising a fan orifice plate having an orifice therein surrounding said rotatable fan blades and optically shielding said evaporator coil from said condenser coil.

9. The improvement according to claim 1, wherein said evaporation coil is tilted at about 20 from the vertical.

10. In a dehumidifier having a closed refrigerant cycle apparatus therein including a condenser, an evaporator, a compressor, and a means for flow connecting refrigerant therebetween, the improvement comprising:

a cabinet having an air inlet opening, a bypass opening, and an air outlet opening;

an air moving device arranged between said air inlet opening and said air bypass opening, and said air outlet opening;

said evaporator arranged between said air inlet opening, and said air moving device, said evaporator coil being tilted from vertical; and said condenser arranged between said air moving device and said air outlet opening.

11. The improvement according to claim 10, further comprising a plate having an orifice for passing air therethrough substantially optically shielding said evaporator from said condenser and arranged therebetween.

12. The improvement according to claim 10, further comprising a drip bucket arranged beneath said evaporator and removable from said cabinet.

13. The improvement according to claim 10, wherein said air bypass opening comprises louvered openings arranged through a side of said cabinet between said evaporator and said air moving device.

14. The improvement according to claim 10, wherein said air bypass opening comprises a top opening through said cabinet.

15. The improvement according to claim 10, wherein said bypass opening comprises an open space below said evaporator within said cabinet in communication with said air inlet.

16. The improvement according to claim 10, wherein said air inlet opening is covered by a grill which is inclined at about 20 from vertical.

17. The improvement according to claim 10, further comprising an orifice plate having an orifice therein surrounding said rotatable air moving device and optically shielding said evaporator from said condenser.

18. The improvement according to claim 10, wherein said evaporator is a coil tilted at about 20 from vertical.

19. A dehumidifier comprising:

a cabinet having an angled front panel with front openings therethrough a substantially vertical back panel with back openings therethrough;

an evaporator coil formed in a plane and located within said cabinet behind said front opening, and said plane angled obliquely downwardly toward said front panel;

a condenser coil located within said cabinet in front of said back openings;

a fan located within said cabinet, said fan having a plurality of rotatable blades and an electric motor for turning said blades, and an orifice plate with an orifice closely surrounding said blades; and said evaporator coil, said condenser coil, and said rotatable blades having substantially the same vertical height and aligned in elevation for substantially horizontal air flow between said front openings and said back openings.

20. The dehumidifier according to claim 19 wherein said plane is angled at about 20 from vertical.

21. The dehumidifier according to claim 19, wherein said cabinet further comprises sidewall openings between said evaporator and said orifice plate to allow air to bypass said evaporator.

22. The dehumidifier according to claim 19, wherein said cabinet further comprises a top opening which is flow open to a space between said evaporator coil and said orifice plate to allow a quantity of air to bypass said evaporator coil.

23. The dehumidifier according to claim 19, wherein said fan is located between said evaporator coil and said condenser coil.

24. The dehumidifier according to claim 19 wherein said evaporator and condenser coils each comprise a serpentine tube.

* * * * *